United States Patent [19]

Berg

[11] Patent Number: 4,991,787

[45] Date of Patent: Feb. 12, 1991

[54] PIVOTING GUIDE FOR WEB CONVEYING APPARATUS

[75] Inventor: Jack V. Berg, Woodbury, Minn.

[73] Assignee: Minnesota Mining and Manufacturing Company, St. Paul, Minn.

[21] Appl. No.: 324,238

[22] Filed: Mar. 15, 1989

[51] Int. Cl.[5] ..... B65H 23/10

[52] U.S. Cl. ..... 242/76; 226/196; 226/198; 226/199

[58] Field of Search ..... 242/76; 226/196, 198, 226/199

[56] References Cited

U.S. PATENT DOCUMENTS

| | | | |
|---|---|---|---|
| 3,107,036 | 10/1963 | Richards et al. | 226/198 |
| 3,730,448 | 5/1973 | Schippers et al. | 242/43.1 |
| 3,883,085 | 5/1975 | Held | 242/65 |
| 3,934,775 | 1/1976 | Keller | 226/196 |
| 4,011,814 | 3/1977 | Real | 24/76 X |
| 4,055,310 | 10/1977 | Bonaiti | 242/7.08 |
| 4,238,271 | 12/1980 | Urushizaki | 156/523 |
| 4,253,905 | 3/1981 | Regan | 136/523 |
| 4,458,856 | 7/1984 | Mansel-James | 242/107 |
| 4,480,740 | 11/1984 | Wurmli | 198/400 |
| 4,482,100 | 11/1984 | Yoshida | 242/55 |
| 4,483,134 | 11/1984 | McKay et al. | 57/18 |
| 4,508,292 | 4/1985 | Kudelski | 242/190 |
| 4,531,998 | 6/1985 | Peterson | 226/198 X |
| 4,592,188 | 6/1986 | Marchetti | 53/137 |
| 4,602,777 | 7/1986 | Bond et al. | 271/9 |
| 4,738,075 | 4/1988 | Marchetti | 53/137 |
| 4,750,660 | 6/1988 | Kamimura | 242/76 X |
| 4,750,966 | 6/1988 | Koller | 156/391 |
| 4,750,968 | 6/1988 | Sweeny | 156/523 |
| 4,783,018 | 11/1988 | Rodriguez | 242/56 R |

FOREIGN PATENT DOCUMENTS

| | | |
|---|---|---|
| 57-31549 | 2/1982 | Japan . |
| 1258799 | 9/1986 | U.S.S.R. . |

*Primary Examiner*—Stuart S. Levy
*Assistant Examiner*—Steven M. duBois
*Attorney, Agent, or Firm*—Donald M. Sell; Walter N. Kirn; Leland D. Schultz

[57] ABSTRACT

A web guide for use with web conveying apparatus. The web guide is pivotally mounted on the apparatus so that movement of the web relative to the web guide is attenuated as the web passes through the web guide.

12 Claims, 5 Drawing Sheets

Fig. 5
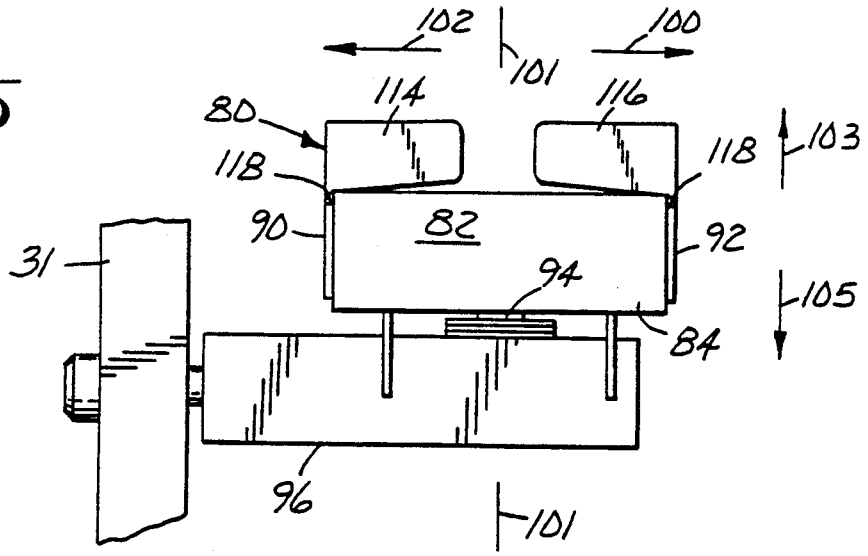
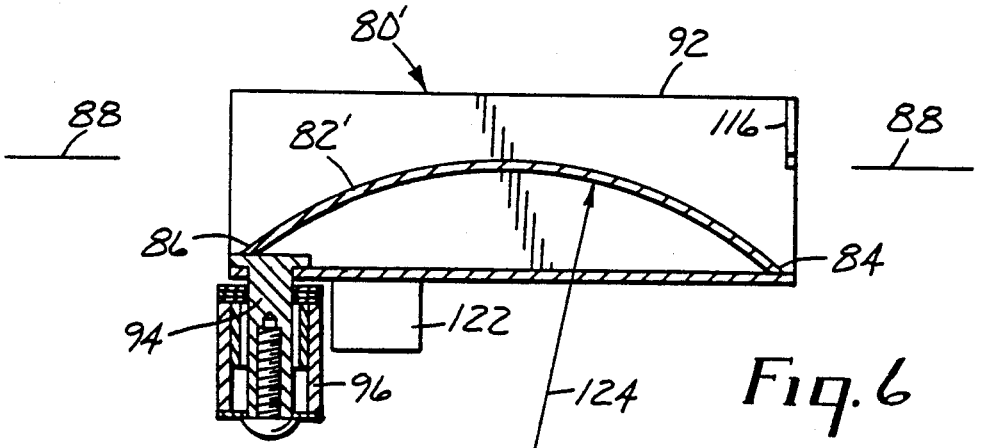
Fig. 6
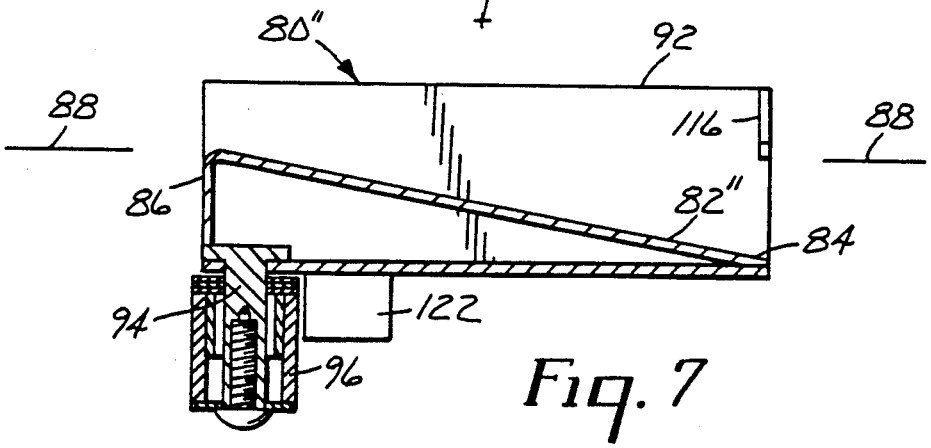
Fig. 7

PIVOTING GUIDE FOR WEB CONVEYING APPARATUS

TECHNICAL FIELD

The present invention relates generally to web conveying equipment and more particularly to guides for web conveying apparatus.

BACKGROUND ART

Apparatus has been developed in the past for conveying webs. For the purposes of this application, the term "web" refers to any continuous elongate strip of flexible material, and specifically includes, but is not limited to, a web constructed of a polymeric film having at least one surface coated with a pressure sensitive adhesive (i.e. tape). Typically, a web is most conveniently provided in roll form, with the web wrapped about a rigid cylindrical core. The web may be wound in roll form in alternate configurations, including, but not limited to, planetary rolls, level wound rolls, and webs wound according to U.S. Pat. Nos. 4,477,035 entitled "Winding a Package of Tape" issued on Oct. 16, 1984; 4,568,033 entitled "Winding a Package of Tape" issued on Feb. 4, 1986; and 4,603,817 entitled "Package of Tape" issued on Aug. 5, 1986, the contents of which are incorporated herein.

Web conveying apparatus may be provided to unwind a web from a roll of the web during manufacturing processes, such as to coat or treat the web. The web conveying apparatus may be incorporated into a tape applicator for applying a length of pressure sensitive adhesive tape to an object. Tape applicators used to apply a length of tape to a regular slotted carton (RSC) are known as case sealers. Similarly, web conveying apparatus may be provided to wind a web unto a core, such when a relatively wide web is unwound, passed through slitting apparatus to longitudinally divide the web into a plurality of parallel narrow webs, each of which is then wound unto a new core of correspondingly reduced width.

Whenever a web is conveyed, it is desirable that the position and movement of the web be controlled as the web is conveyed along a desired path. Conventional web conveying apparatus have therefore included structure for guiding the web as the web is being conveyed. Guide structures for conventional web conveying apparatus have included guide blocks or "shoes" mounted in the path of the web. The guide blocks have a stationary surface over which the web passes and may include a pair of longitudinally extending laterally spaced walls for constricting side to side movement of the web as it passes through the guide block. Alternatively, rollers have also been used and likewise mounted in the path of the web. Laterally spaced walls may also be employed as with the guide blocks.

These conventional stationary guide structures have not proved completely effective in eliminating or reducing fluctuations in the movement of a web as it is conveyed. Particularly for relatively thin flexible webs, lateral movement of the web may result in "edge folding" in which a portion of the tape is partially or wholly longitudinally inverted or folded back upon itself. If the web takes the form of a pressure sensitive adhesive tape, the inverted adhesive surface of the tape may be self adhering, or may adhere to the web conveying apparatus. In the case of a tape applicator, the pressure sensitive adhesive tape becomes inoperative if edge folding occurs.

DISCLOSURE OF INVENTION

The present invention provides for a web guide for use with apparatus for conveying a web along a web path. The web guide includes a web conveying surface extending between a first end and a second end along a longitudinal axis. The web conveying surface extends between a pair of longitudinally extending side plates. Means are provided for mounting the web guide on the web conveying apparatus in the web path so that the web passes over the web conveying surface from the first end of said web conveying surface to the second end of said web conveying surface between the pair of side plates. The mounting means enables the web guide to pivot about an axis adjacent the second end of the web guide and transverse to the longitudinal axis and the web so that transverse movement of the web is attenuated between the first end and the second end of the web conveying surface.

The present invention further provides for the web guide described hereinabove in combination with web conveying apparatus.

BRIEF DESCRIPTION OF DRAWINGS

The present invention will be further described with reference to the accompanying drawing wherein like reference numerals refer to like parts in the several views, and wherein:

FIG. 5 is a front view of the web guide of FIGS. 3 and 4

FIG. 6 is a cross sectional view of an alternate embodiment of the web guide of FIG. 3.

FIG. 7 is a cross sectional view of another alternate embodiment of the web guide of FIG. 3.

DETAILED DESCRIPTION

Figure 1A:
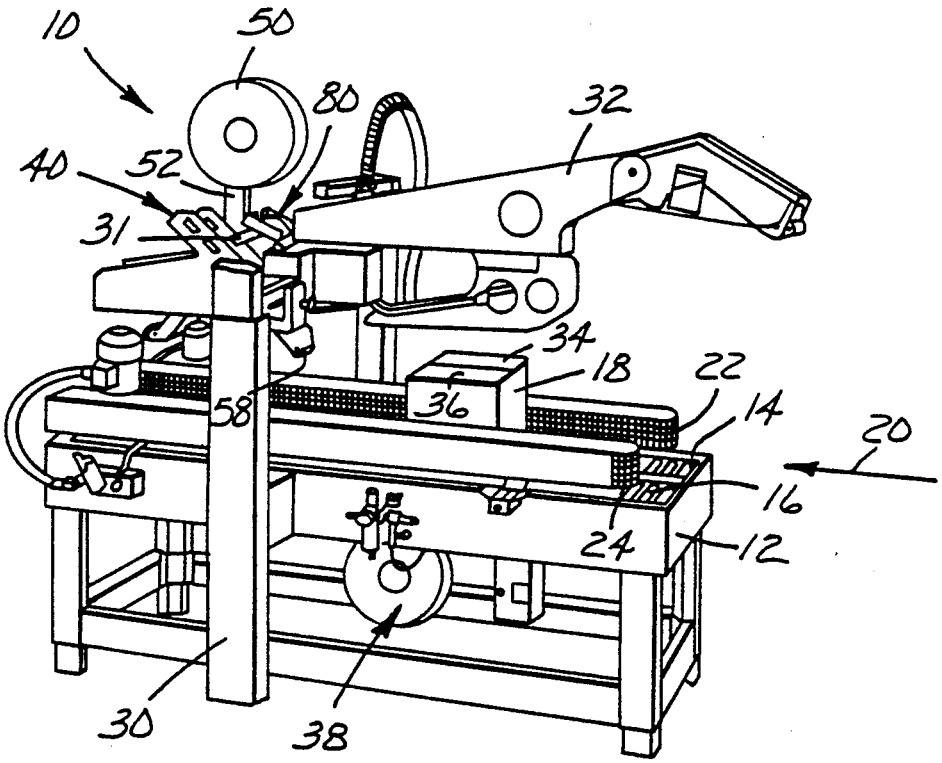
FIG. 1A is an isometric view of apparatus according to the present invention for conveying a web.

Referring now to FIG. 1A, there is shown apparatus for conveying a web generally designated by the reference numeral 10. The illustrated apparatus is a case sealer for applying a strip of pressure sensitive tape to the center seam of a regular slotted carton (RSC). In particular, the illustrated apparatus represents a Model 12AF Automatic Adjustable Case Sealer available from the Minnesota Mining and Manufacturing Co. of St. Paul, Minn. Generally, apparatus 10 comprises stand 12 having horizontal top surface 14. Conveyer section 16 is incorporated into top surface 14 for supporting and conveying carton 18 through the apparatus in direction 20. A pair of powered drive belts 22 and 24 are mounted on top surface 14 and positioned to frictionally engage the sides of each carton 18 to move the carton in direction 20. Frame 30 extends above stand 12 and top surface 14 and supports mechanism 32 for automatically folding the flaps 34 and 36 of the carton 18 prior to the sealing of the carton, which mechanism is known in the art and will not be described in greater detail herein.

Lower tape applicator 38 is mounted on stand 12. Upper tape applicator 40 is mounted on frame 30 in a manner so that the height of the upper tape applicator is adjustable, along with flap folding mechanism 32 to accommodate a series of cartons of like size. Although any suitable tape applicator mechanism may be employed to apply tape to the cartons, in the illustrated embodiment of the invention the upper and lower tape applicators are constructed according to U.S. Pat. No. 4,238,269 issued to Deering Jr., the contents of which are incorporated herein by reference. Tape applicators according to this patent are marketed by the Minnesota Mining and Manufacturing Co. of St. Paul, Minn. under the trademark "Accuglide".

Figure 1B:
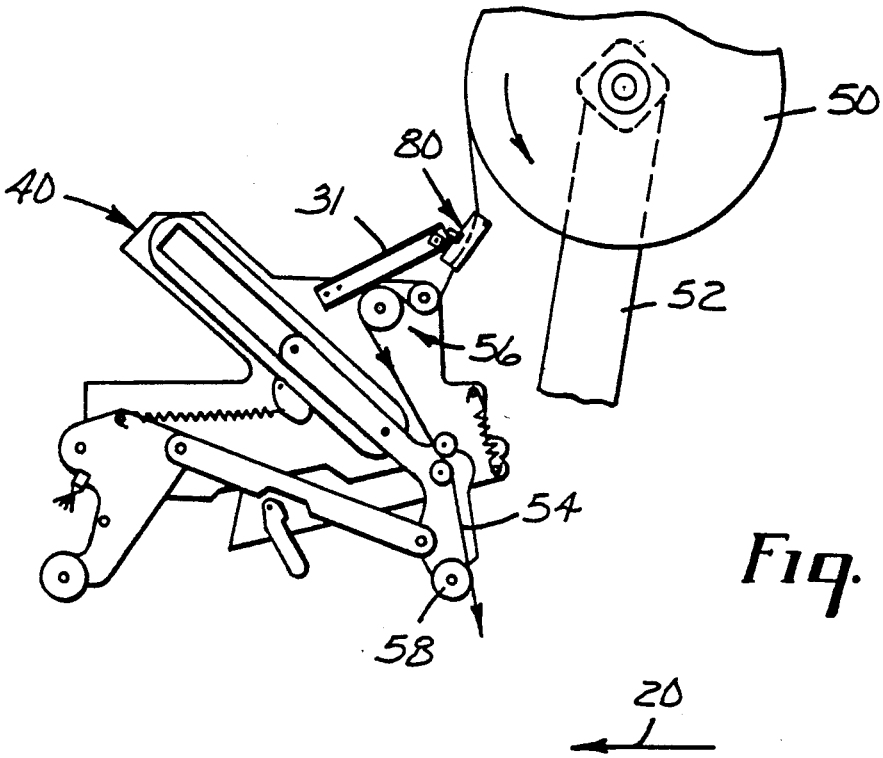
FIG. 1B is an isometric of portion of alternate apparatus according to this invention for conveying a web.

Referring now to FIG. 1B, upper tape applicator 40 is shown. Planetary roll of tape 50 is rotatively mounted on tape support arm 52, which is mounted on upper tape applicator 40. Web or tape 54 is conveyed along a desired tape path from roll 50 through guide mechanism 56 to applying roller 58. As is more particularly described in the aforementioned U.S. Pat. No. 4,238,269, the end of tape 54 contacts the front side of a carton as the carton is conveyed past the applying roller. Continued movement of the carton in direction 20 pulls additional tape from roll 50 through guide mechanism 56 and onto the top and trailing sides of the carton over the center seam thereof. The tape is then severed and the end of the remaining tape is in position for the next carton.

Figure 2A:
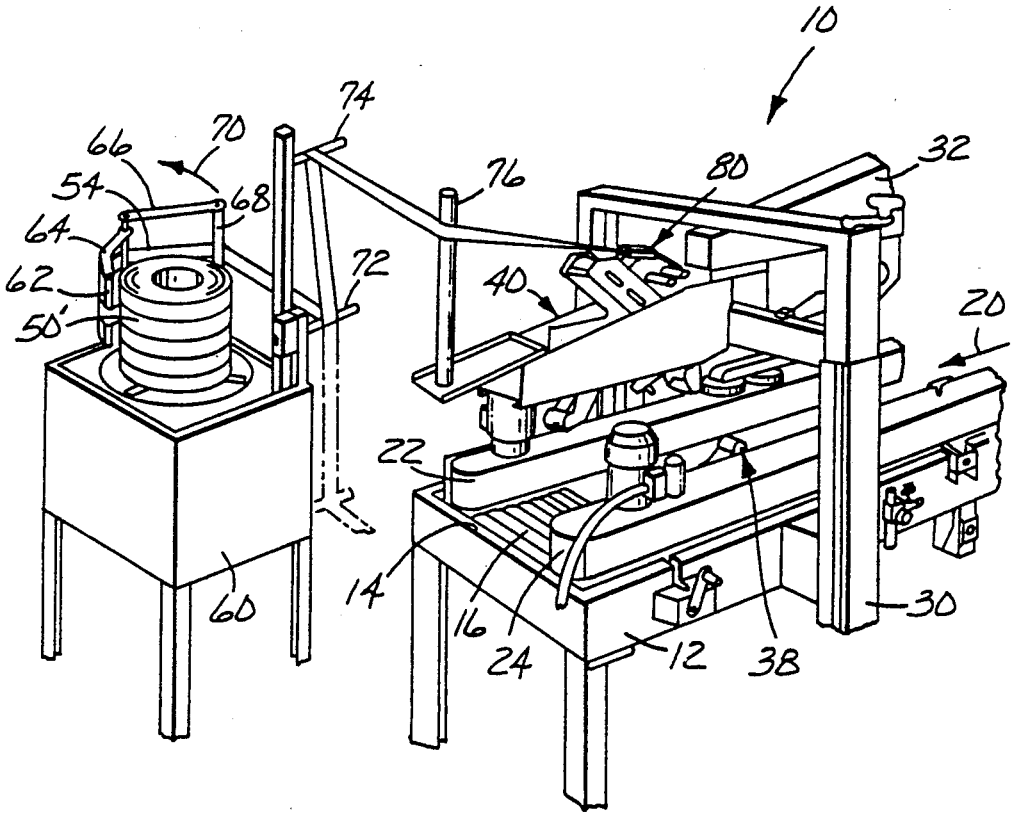
FIG. 2A is a partial side view, partially broken away, of the apparatus of FIG. 1.
Figure 2B:
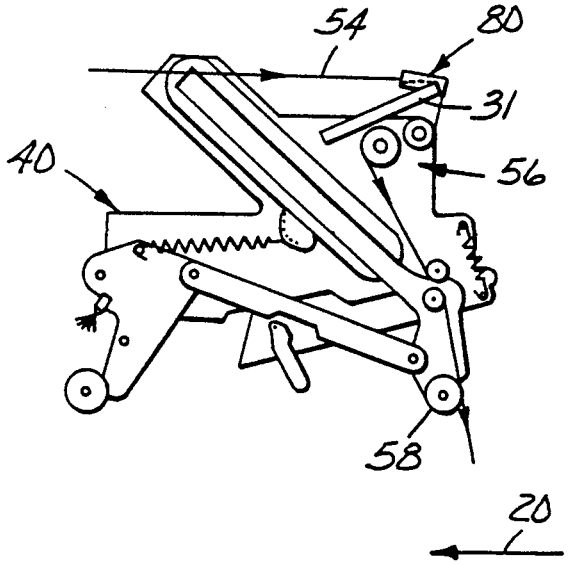
FIG. 2B is a partial side view, partially broken away, of the apparatus of FIG. 1A.

FIGS. 2A and 2B illustrate an alternate embodiment of this invention when the web is provided in a roll 50′ wound according to the aforementioned U.S. Pat. Nos. 4,477,035, 4,568,033 and 4,603,817. Due to the weight of roll 50,, the roll is vertically oriented and rotatively supported on stand 60. Nip roller 62 is mounted on arms 64 in close proximity to the outermost layer of the web 54 on roll 50′ and provides a sharp change in direction for the web as it is pulled off of the roll. Dancer arm 66 includes roller 68 over which the web extends. Dancer arm 66 is biased in rotational direction 70 and provides a compensating tension on the web as the web is pulled from the roll. Web 54 is then conveyed to first idler roller 72 having a surface adapted to reduce friction with the surface of the web passing thereover. If web 54 is provided as a pressure sensitive adhesive tape, the web is twisted between the roller 68 and the first idler roller 72 so that the surface having the adhesive is presented to the first idler roller. The web then is conveyed to second idler roller 74 located generally vertically above the first idler roller 72. Both the first and second idler rollers are positioned generally horizontally. The web is then conveyed to third idler roller 76 mounted upright on upper tape applicator 40. If the web is a pressure sensitive adhesive tape, the web is twisted between the second and the third idler rollers 74 and 76, respectively, so that the adhesive surface of the tape is not in contact with the third idler roller. The tape path then extends towards the tape applicator with the pressure sensitive adhesive surface of the tape uppermost.

In the case of the roll 50′, the web is wound in pattern that includes a fixed number of "planetary" layers at multiple adjacent locations on the core. While the web is wound on the core and the required number of layers is achieved, the web is rapidly shifted to the next location for winding. Locations on the end of the core receive double the usual number of layers before the web is shifted back though the intermediate locations towards the opposite end of the core. Fluctuations in the position of the web relative to the web conveying apparatus during unwinding operations is particularly severe while the web is being shifted from one location to another.

In either of the above embodiments, and as shown in FIGS. 1B and 2B, respectively, web guide 80 is mounted by bracket 31 on upper tape applicator 40 along the tape path intermediate the roll of the web and applying roller 58, and in particular, intermediate roll 50 and guide mechanism 56 of the upper tape applicator 40.

Figure 3:
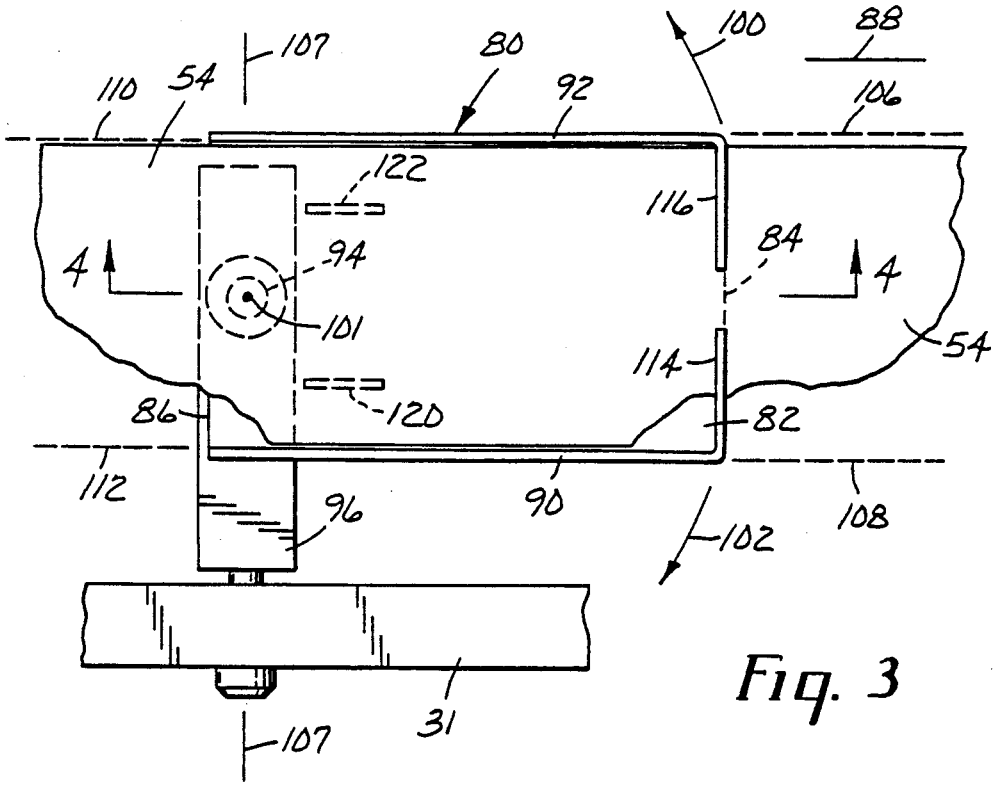
FIG. 3 is a top view of the web guide of FIGS. 2 and 2A with a web partially broken away.
Figure 4:
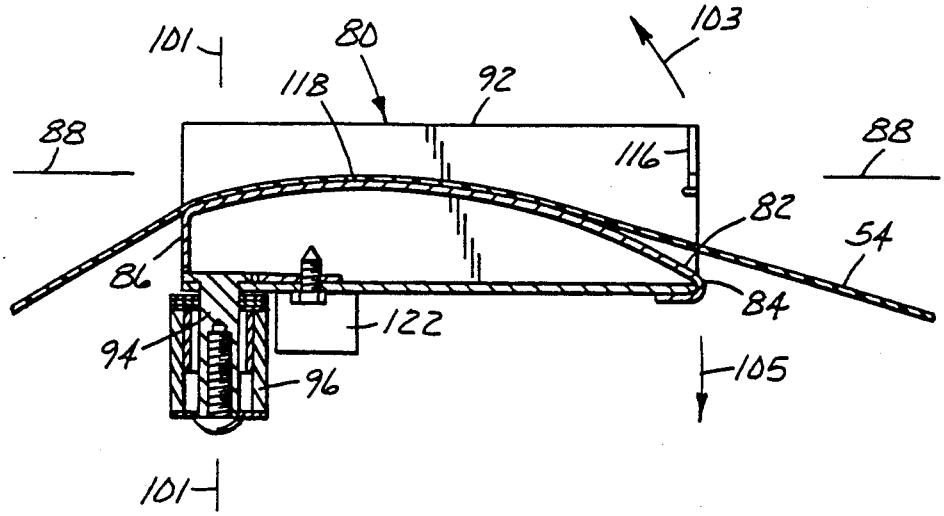
FIG. 4 is a cross sectional view along plane 4—4 of the web guide of the apparatus of FIG. 3.

Web guide 80 is shown in greater detail in FIGS. 3–5. Web guide 80 includes arcuate web conveying surface 82 having first end 84 and second end 86 and includes longitudinal axis 88. A pair of longitudinally extending, laterally spaced side plates 90 and 92 extend along the sides of the web conveying surface 82. Side plates 90 and 92 are preferably parallel and are laterally spaced by a distance slightly greater than the width of web 54. Web conveying surface 82 and side plates 90 and 92 are mounted on rod 94 at a point adjacent second end 86 of the web conveying surface 82. Rod 94 is in turn mounted on block 96. Block 96 is mounted on upper tape applicator 40 by bracket 31 so that first end 84 of the web conveying surface 82 is directed towards roll 50 along the tape path.

Web conveying surface 82 and side plates 90 and 92 are mounted on rod 94 to enable free pivoting movement with respect to block 96 in rotational directions 100 and 102 (shown in FIGS. 3 and 5) about a first axis 101 extending through the rod (i.e. transverse to longitudinal axis 88 and to web 54).

. In operation, as web 54 passes over web conveying surface 82 with the pressure sensitive adhesive surface of the web located opposite the web conveying surface, the position of the web with respect to the web guide may vary rapidly between lateral boundaries 106 and 108. As the position of the web thus varies, first end 84 of the web conveying surface 82 and side plates 90 and 92 pivot responsive to movement of the web. As web 54 passes towards second end 86 of web conveying surface 82 and axis 101 extending through rod 94, the movement of the web is progressively constrained by the side plates and the web conveying surface. Although the angular movement of the web guide is unchanged, the transverse distances allowed the web by the side plates progressively diminishes as the web passes though the web guide towards the second end 86 of the web conveying surface and over axis 101. In this manner, movement of the web 54 is attenuated after the web passes through web guide 80 of the present invention.

As shown in FIG. 3, lateral movement of web 54 after passing through web guide 80 is attenuated so as to fall between lateral boundaries 110 and 112 which are substantially more restricted than lateral boundaries 106 and 108 on the opposite side of the web guide. Web 54 is now able to be conveyed to a desired location with greater accuracy and control, particularly as compared to the effect of stationary guides or rollers. Further, the gradual attenuation of the movement of the web as the web passes through the web guide reduces or eliminates "edge folding" of the tape subsequent to the web guide.

The orientation of the web conveying surface 82, side plates 90 and 92, and rod 94 mounted on block 96 may be adjusted relative to bracket 31 in rotational directions 103 and 105 as shown in FIGS. 4 and 5 (i.e. about a second axis 107 extending through the block transverse to both the longitudinal axis 88 and to first transverse axis 101). Preferably, the orientation of the web with respect to the web guide is adjusted in rotational directions 103 and 105 so that the tangent line at which web 54 contacts web conveying surface 82 falls intermediate the first end 84 of the web conveying surface and the midpoint of the web conveying surface.

The web guide 80 of this invention may be effectively mounted horizontally, vertically, or any other desired position. However, if mounted in a position other than horizontal, the guide block may be constructed to constrict movement of web 54 away from web conveying surface 82. One arrangement provided for this purpose is shown in FIG. 5. Fingers 114 and 116 extend inwardly from side plates 90 and 92 at first end 84 of the web conveying surface 82.

In the illustrated embodiment, stops 120 and 122 extend downwardly from the side plates 90 and 92. Contact between the stops 120 and 122 and block 96 act to limit extremes in the pivoting movement of the web conveying surface 82 and the side plates 90 and 92 in rotational directions 100 and 102. In the preferred embodiment of the invention, the stops do not interfere with the pivoting of the web conveying surface 82 in response to movement of a web passing through web guide 80. Rather, the stops 120 and 122 conveniently maintain first end 84 of the web conveying surface oriented generally in the direction of the web path during the routing of the end of the web through the guide structure prior to use.

Another embodiment of the web guide of this invention may include a counter weight (not shown) mounted on the web guide with rod 94 positioned intermediate the counterweight and the first end 84 of the web conveying surface 82. The counterweight reduces or eliminates the effect of gravity on the pivoting movement of the web guide 80 if mounted in a position other than horizontal. The web conveying surface may also be treated or coated with a friction reducing material, such as Teflon, to facilitate the passage of the web thereover.

Figure 8:
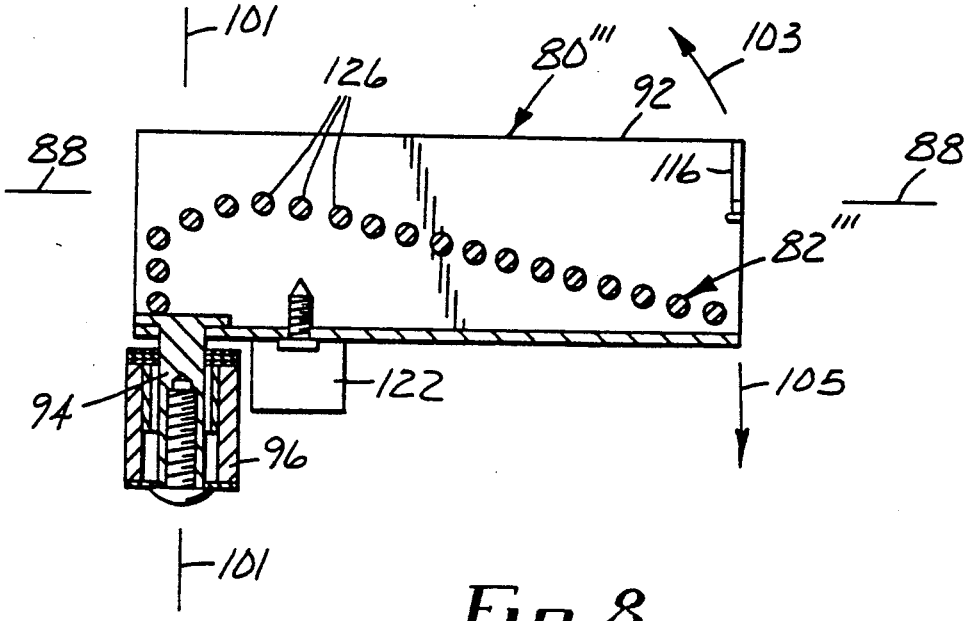
FIG. 8 is a cross sectional view of yet another alternate embodiment of the web guide of FIG. 3.

The web conveying surface 82 illustrated in FIGS. 3—5 is generally arcuate and includes a rounded peak at 118 located between the mid point and the second end thereof. An alternate embodiment 80, of the web conveying surface 82' is shown in FIG. 6 wherein the web conveying surface is a circular section having a constant radius 124 about a point aligned with the midpoint of the web conveying surface. Another alternate embodiment 80'', of the web conveying surface 82'' is shown in FIG. 7 wherein the web conveying surface is a generally flat plane inclined upwardly with respect to side plates 90 and 92 from first end 84 to the second end 86. Other configurations may be employed as are found effective for a particular application. For instance, in FIG. 8, another alternate embodiment of the web guide 80''' is shown having a web conveying surface 82''' constructed of spaced transverse pins 126 mounted between side plates 90 and 92 in the same profile as the web conveying surface 82 of the embodiment shown in FIGS. 3-5. Of course, other configurations may be constructed, if desired. It is believed that it is necessary to the functioning of this invention that the web must slide or slip over the web conveying surface and that a roller or other like device would not function as desired.

The web guide of the present invention is effective in reducing or eliminating edge folding of a web. For instance, in the embodiment of the invention shown in FIGS. 1A and 2A, a roll wound according to the aforementioned U.S. Pat. Nos. 4,477,035, 4,568,033 and 4,603,817 was provided utilizing No. 373 brand pressure sensitive adhesive tape available from Minnesota Mining and Manufacturing Co. of St. Paul Minn. A roll of 6,000 yards (5.5 km) of No. 373 tape having a polypropylene backing 1.75 inches (4.44 cm) in width and 0.002 inches (0.05 mm) in thickness was wound upon a cardboard core having a 6.0 inch (15.2 cm) internal diameter. The roll had an outer diameter of approximately 12.0 inches (30.5 cm) and weighed approximately 35 pounds (77 kg). If mounted as used as shown in FIGS. 1A and 2A in conjunction with the Accuglide TM taping head and the 12AF case sealer herein described, tape is intermittently applied to a moving RSC carton at approximately 70 feet per minute. Using conventional stationary guide blocks or rollers, the tape has been observed to deflect transversely by as much as 0.875 inches (2.22 cm). However, with the pivoting web guide of the present invention, the transverse movement of the web has been limited to within 0.062 inches (0.16 cm) of the desired web path after passing through the web guide. For the tape described above, the side plates 90 and 92 are spaced approximately 0.030 inches (0.08 cm) wider than the width of the web.

The present invention has now been described with reference to several embodiments thereof. It will be apparent to those skilled in the art that many changes can be made in the embodiments described without departing from the scope of the present invention. Thus, the scope of the present invention should not be limited to the structures described in this application, but only by structures described by the language of the claims and the equivalents of those structures.

What is claimed is:

1. Apparatus for conveying a web, comprising:

(a) means for conveying a web along a path;

(b) a web guide having a web conveying surface extending between a first end and a second end along a longitudinal axis, said web conveying surface extending between a pair of longitudinally extending laterally side plates;

(c) means for supporting said web guide in said web path so that said web passes over said web conveying surface from said first end of said web conveying surface to said second end of said web conveying surface between said pair of side plates, said supporting means enabling said web guide to pivot about an axis adjacent said second end of said web guide and transverse to said longitudinal axis of said web conveying surface and to the web so that transverse movement of the web is attenuated between said first end and said second end of said web conveying surface.

2. The apparatus of claim 1, wherein said web conveying surface is arcuate.

3. The apparatus of claim 1, wherein said web guide further includes means for restricting movement of the web away from said web conveying surface as the web passes from said first end of said web conveying surface to said second end of said web conveying surface.

4. The apparatus of claim 1, wherein said web conveying surface is adapted to minimize friction with the web as the web passes over said web conveying surface.

5. Apparatus for conveying a web from a roll of the web, comprising:

(a) means for rotatively supporting the roll of the web;

(b) means for continuously pulling the web from the roll along a web path to a desired location relative to said frame;

(c) a web guide having a web conveying surface extending between a first end and a second end along a longitudinal axis, said web conveying surface extending between a pair of longitudinally extending laterally spaced side plates; and (d) means for supporting said web guide in said web path so that the web passes over said web conveying surface from said first end of said web conveying surface to said second end of said web conveying surface between said pair of side plates, said mounting means enabling said web guide to pivot about an axis adjacent said second end of said web guide and transverse to said longitudinal axis of said web conveying surface and the web so that transverse movement of the web is attenuated between said first end and said second end of said web conveying surface.

6. The apparatus of claim 5, wherein said web conveying surface is arcuate.

7. The apparatus of claim 5, wherein said web guide further includes means for restricting movement of the web away from said web conveying surface as the web passes from said first end of said web conveying surface to said second end of said web conveying surface.

8. The apparatus of claim 5, wherein said web conveying surface is adapted to minimize friction with the web as the web passes over said web conveying surface.

9. A web guide for use with apparatus for conveying a web along a web path, comprising:

(a) a web conveying surface extending between a first end and a second end along a longitudinal axis, said web conveying surface extending between a pair of longitudinally extending side plates; and (b) means for mounting said web guide on the web conveying apparatus in said web path so that the web passes over said web conveying surface from said first end of said web conveying surface to said second end of said web conveying surface between said pair of side plates, said mounting means enabling said web guide to pivot about an axis adjacent said second end of: said web guide and transverse to said longitudinal axis and the web so that transverse movement of the web is attenuated between said first end and said second end of said web conveying surface.

10. The web guide of claim 9, wherein said web conveying surface is arcuate.

11. The web guide of claim 9, wherein said web guide further includes means for restricting movement of the web away from said web conveying surface as the web passes from said first end of said web conveying surface to said second end of said web conveying surface.

12. The web guide of claim 9, wherein said web conveying surface is adapted to minimize friction with the web as the web passes over said web conveying surface.

* * * * *

UNITED STATES PATENT AND TRADEMARK OFFICE

CERTIFICATE OF CORRECTION

PATENT NO. : 4,991,787

DATED : February 12, 1991

INVENTOR(S) : Berg

It is certified that error appears in the above-identified patent and that said Letters Patent is hereby corrected as shown below:

Col. 3, line 38, "50,," should read --50',--.

Col. 5, line 47, "80," should read --80'--.

Col. 5, line 52, delete "," after "80""

Col. 8, line 17, delete ":" after "of".

Signed and Sealed this

Twentieth Day of April, 1993

*Attest:*

MICHAEL K. KIRK

*Attesting Officer*

*Acting Commissioner of Patents and Trademarks*